US005491855A

United States Patent [19]

Charles

[11] Patent Number: 5,491,855

[45] Date of Patent: Feb. 20, 1996

[54] CERVICAL TEE APPLIANCE

[76] Inventor: Brion R. Charles, 1924 Bush St. Apt. B., San Francisco, Calif. 94115

[21] Appl. No.: 202,643

[22] Filed: Feb. 28, 1994

[51] Int. Cl.[6] ..... A47C 20/02

[52] U.S. Cl. ..... 5/636; 5/643

[58] Field of Search ..... 5/622, 643, 925, 5/636; 606/204.15, 240; 248/176

[56] References Cited

U.S. PATENT DOCUMENTS

| | | | |
|---|---|---|---|
| 238,038 | 2/1881 | Frazee | 5/622 |
| 310,884 | 1/1885 | DeMotte | 5/622 |
| 327,967 | 10/1885 | Shaw | 5/622 |
| 1,984,520 | 12/1934 | Curtis | 606/240 |
| 2,120,310 | 6/1938 | Duncan | 5/643 |
| 2,509,086 | 5/1950 | Eaton | 5/636 |
| 2,618,041 | 11/1952 | Nelson | 5/636 |
| 2,818,854 | 1/1958 | Johnson | 606/240 |
| 2,841,857 | 7/1958 | Blachly | 5/636 |
| 4,923,187 | 5/1990 | Mombrinie | 5/925 |
| 5,127,616 | 7/1992 | Carney | 248/176 |

*Primary Examiner*—Michael J. Milano

[57] ABSTRACT

A cervical tee appliance including a cervical support member disposed at an angle of ten degrees to a vertical reference and affixed to a base member. The base member comprises a thick plate having a slot for engagement of the cervical support member and a frictionally engaging treatment of a surface engaging a floor. Frictionally engaging treatment of the base member may comprise rubber feet or a non-skid coating. The cervical support member comprises a central semicircular cutout which does not engage the cervical spine and symmetrically disposed scalloped portions which engage the atlantoocipital joint, and furthermore the engaging portions are covered by a cushioning layer. An alternate embodiment provides an adjustment for the angular disposition of the cervical support member.

1 Claim, 4 Drawing Sheets

FIG 7
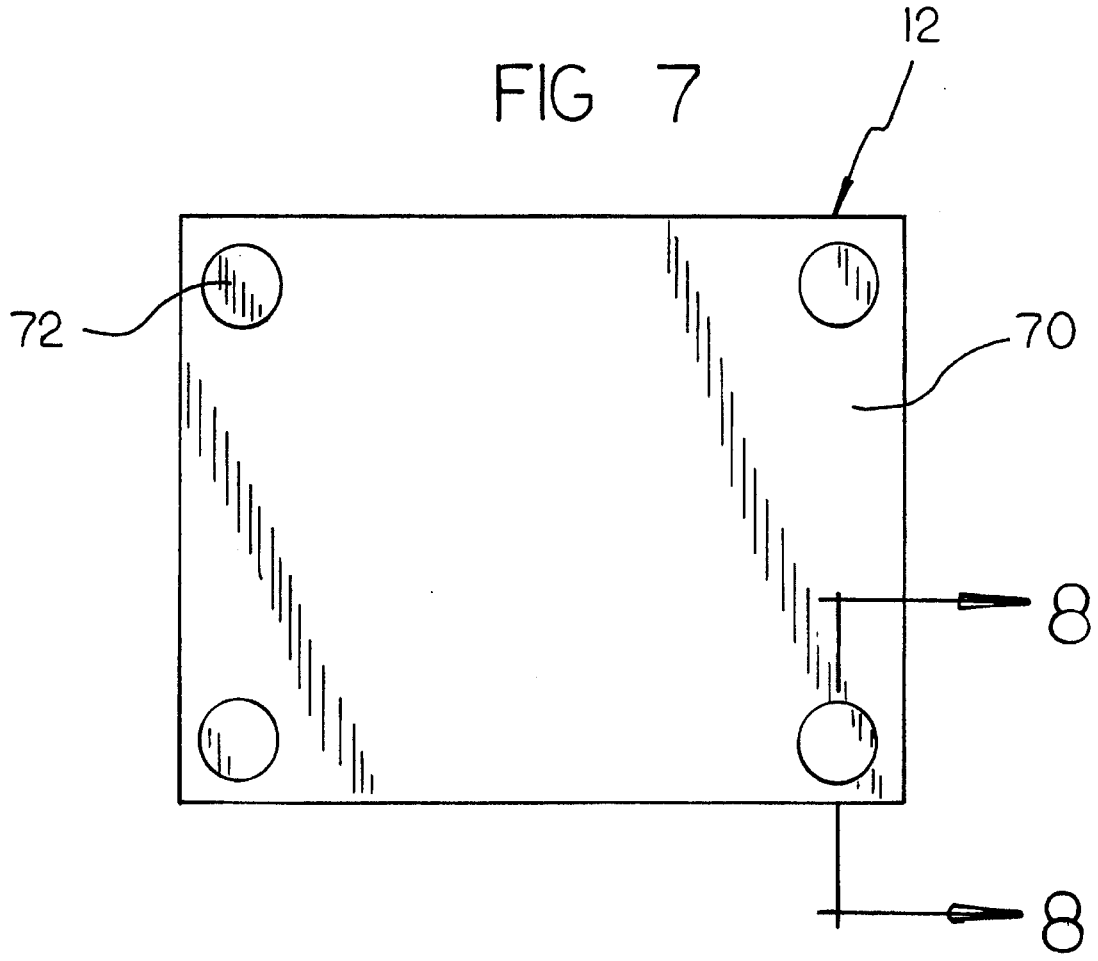
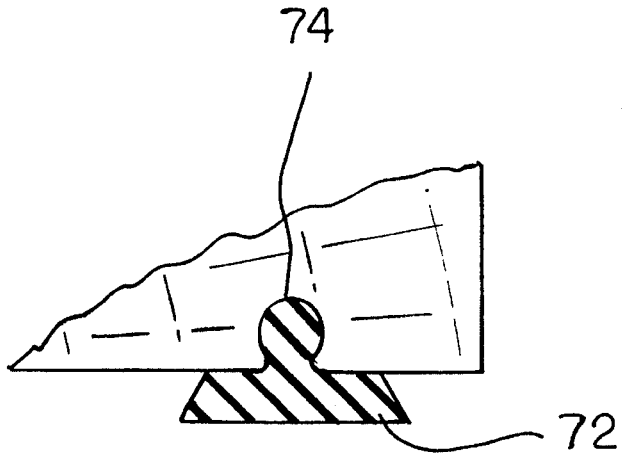
FIG 8

CERVICAL TEE APPLIANCE

BACKGROUND OF THE INVENTION

1. Field of the Invention

The present invention relates to cervical support modalities employed in the branch of medicine known as physical therapy and more particularly pertains to a cervical tee appliance which may be disposed in a manner supporting the neck of a prone human to apply a continuous force to a region at the head-neck interface known as the atlantooccipital joint.

2. Description of the Prior Art

The use of cervical supporting apparatus is known in the prior art. More specifically, cervical supporting apparatus heretofore devised and utilized for the purpose of therapeutic support of members of the cervical vertebrae are known to consist basically of familiar, expected and obvious structural configurations, notwithstanding the myriad of designs encompassed by the crowded prior art which have been developed for the fulfillment of countless objectives and requirements.

The present invention is directed to improving devices for therapeutic cervical support substantially localized at the atlantooccipital joint in a manner which is safe, secure, economical and aesthetically pleasing.

For example, U.S. Pat. No. 4,424,599 to Hannouche discloses a cervical pillow comprising shoulder, occipital, and neck engaging portions wherein the pillow provides a substantially continuous support from the occipital to the shoulder portion of the user. The Hannouche invention comprises no provision for specific modalities requiring directed support of the atlantooccipital joint. The present invention comprises a means for application of directed support of the atlantooccipital joint and may be employed therapeutically thereon.

In U.S. Pat. No. 4,550,458 to Fiore a cervical support pillow is disclosed. The Fiore invention comprises a pillow having a large semicircular cutout portion and two small semicircular cutout portions wherein a region of pillow material disposed between said small and large cutout portions provides support for the cervical region. The Fiore pillow may additionally be folded about the head and maintained thereon by strap members wherein the pillow having a cervical support portion and side portions folded against the ears provides cervical support in sleeping on one's back or side. The Fiore invention does not provide the directed support of the atlantooccipital joint required for certain therapies. The present invention is devised to produce directed atlantooccipital support in a manner which satisfies the needs of various treatment and stress relief modalities.

In U.S. Pat. No. 4,759,089 to Fox a cervical pillow is described wherein the pillow supports the head and neck of a user in a substantially horizontal position to relieve muscular pressure between the head and upper portion of the cervical spine. The pillow additionally cradles the head at the sides and positions the chin toward the chest. The present invention maintains directed support of the atlantooccipital joint and is not intended to provide generalized head and neck support.

In U.S. Pat. No. 5,016,303 to Tanaka et al. a cervical and head support pillow is disclosed for adjustably supporting the head and neck by means of two repositionable support rolls acting in conjunction and further confined within a single encasement. A disadvantage in this prior art lies in a lack of directed support of the atlantooccipital joint irregardless of any disposition of the support rolls encased therein. The present invention supports the atlantooccipital joint and thereby provides a desirable therapeutic modality.

U.S. Pat. No. Des. 292,460 to Malin discloses the ornamental design of a cervical pillow. The Malin disclosure comprises a flattened base portion having two semicylindrical neck and head support rolls of widely differing diameter disposed thereon, and furthermore the composition of the pillow comprises a foamed substance such as polyurethane. There is no provision for directed support of the atlantooccipital joint in the Malin invention. The present invention provides support of the atlantooccipital joint and does not generally support other head or neck areas.

In this respect, the cervical tee appliance according to the present invention substantially departs from the conventional concepts and designs of the prior art, and in so doing provides an apparatus primarily developed for the purpose of providing directed support of the atlantooccipital joint.

Therefore, it can be appreciated that there exists a continuing need for new and improved cervical supports which can be used for the therapeutic support of the atlantooccipital joint of the cervical spine. In this regard, the present invention substantially fulfills this need.

As illustrated by the background art, efforts are continuously being made in an attempt to improve cervical support devices. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of cervical support pillows and devices now present in the prior art, the present invention provides an improved cervical tee appliance construction wherein the same can be utilized for providing directed support at the atlantooccipital joint otherwise described as the first joining region of the skull and neck. As such, the general purpose of the present invention, which will be described subsequently in greater detail, is to provide a new and improved cervical support apparatus and method which has all the advantages of the prior art cervical supports and none of the disadvantages.

The invention is defined by the appended claims with the specific embodiment shown in the attached drawings. For the purpose of summarizing the invention, the invention may be incorporated into an inverted tee having a flattened base member and a substantially upright cervical engaging member wherein the upright cervical support member is affixed to the base member at an acute angle. And, when operationally disposed, the cervical support member renders a component of force to the posterior basilar part of the occipital bone substantially along the axis of the posterior longitudinal ligament and a component of force substantially normal to the cervical spine in the region of the posterior atlantooccipital membrane, wherein the combined effects of these forces comprise a modality of significant use in physical therapy.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide an improved cervical support apparatus.

It is therefore an additional object of the present invention to provide a new and improved cervical tee appliance which has all the advantages of the prior art cervical support devices and none of the disadvantages.

It is another object of the present invention to provide a new and improved cervical tee appliance which may be easily and efficiently manufactured and marketed.

It is a further object of the present invention to provide a new and improved cervical tee appliance which is of a durable and reliable construction.

An even further object of the present invention is to provide a new and improved cervical tee appliance which is susceptible of a low cost of manufacture with regard to both materials and labor, and which accordingly is then susceptible of low prices of sale to the consuming public, thereby making such cervical tee appliances economically available to the buying public.

Still yet another object of the present invention is to provide a new and improved cervical tee appliance which provides in the apparatuses and methods of the prior art some of the advantages thereof, while simultaneously overcoming some of the disadvantages normally associated therewith.

Still another object of the present invention is to provide a new and improved cervical tee appliance capable of providing directed support of the atlantooccipital joint.

Yet another object of the present invention is to provide a new and improved cervical tee appliance which incorporates features wherein beneficial tension is realized in several of the ligaments and muscles supporting the head and cervical vertebrae, and furthermore said beneficial tension results from the weight and frictional engagement of portions of a prone, upward facing human body with a floor.

Even still another object of the present invention is to provide a new and improved cervical tee appliance having a small size and low weight thereby providing a great degree of portability.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is a side elevational view of a cervical tee appliance showing the underside of a base member.

FIG. 8 is a fragmentary sectional view of a cervical tee appliance showing a foot member.

DESCRIPTION OF THE PREFERRED EMBODIMENT

Figure 1:
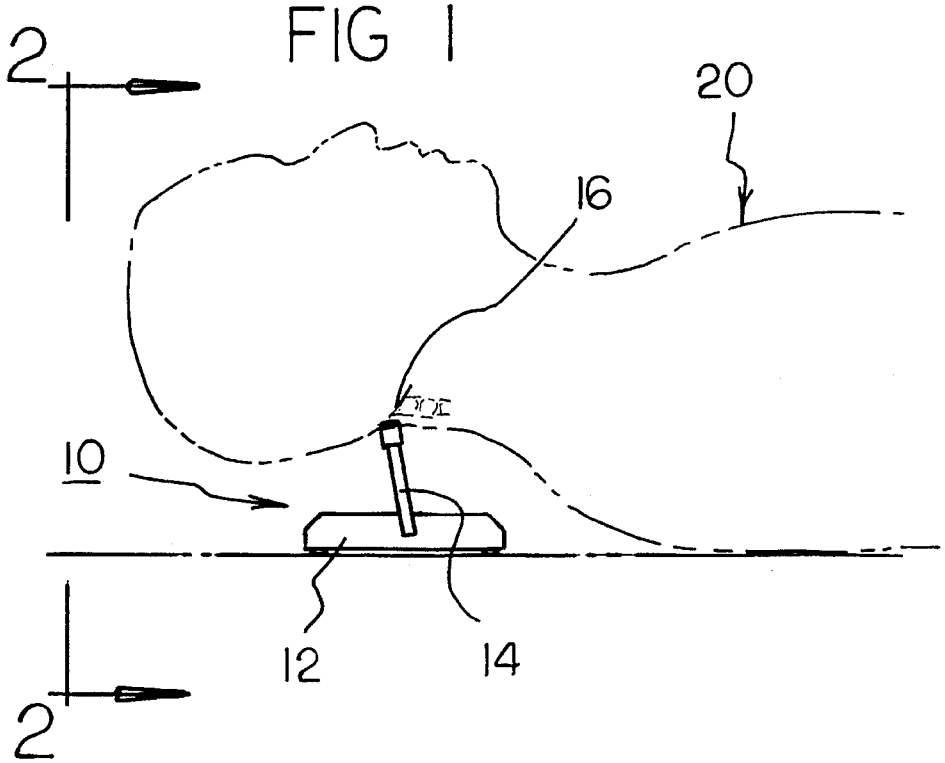
FIG. 1 is a side elevational view of the cervical tee appliance showing an operational disposition.
Figure 2:
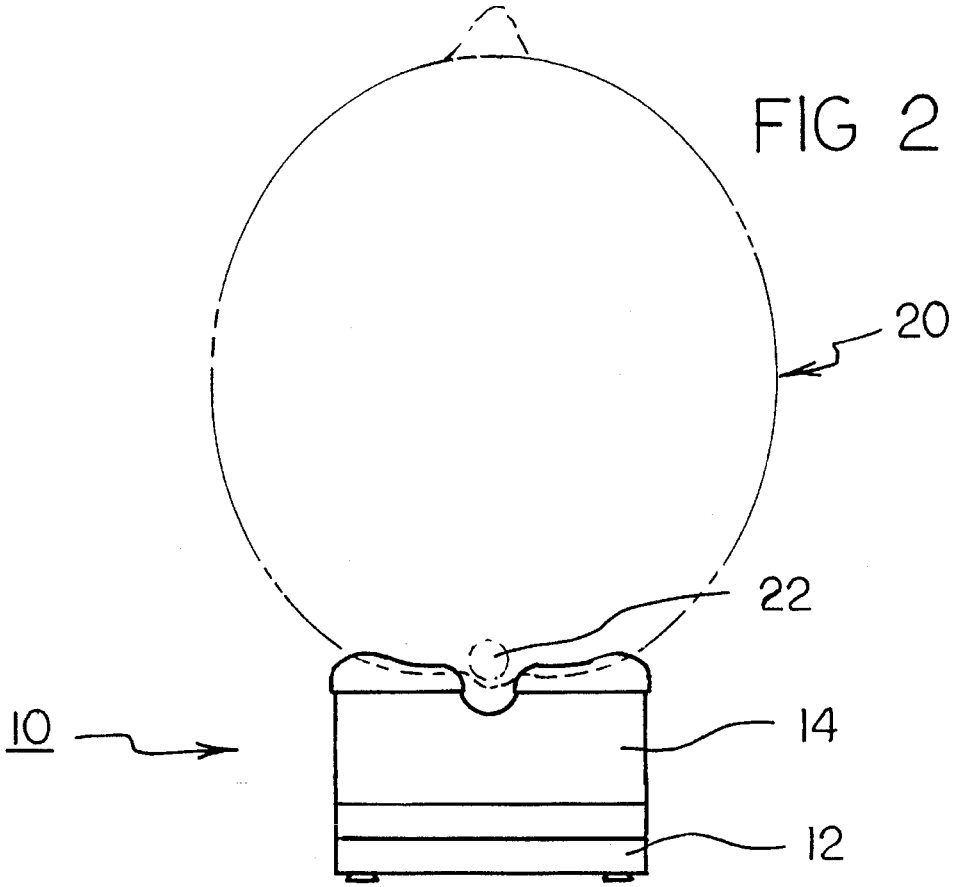
FIG. 2 is a side elevational view of the cervical tee appliance showing an operational disposition.

With reference now to the drawings, and in particular to FIG. 1 thereof, a new and improved cervical tee appliance embodying the principles and concepts of the present invention and generally designated by the reference numeral 10 will be described.

From an overview standpoint, the cervical tee appliance is adapted for use by humans to apply directed support of the cervical vertebrae particularly in the region of the atlantooccipital joint. See FIG. 1. The cervical tee appliance 10 comprises a flattened base member 12 and a cervical support member 14 which are joined to form a rigid structure having the cervical support member 14 deviating from a normal to a surface of the base member 12 by a small angle.

More specifically, it will be noted that the cervical tee appliance 10 provides directed support for atlantooccipital joint 16 by having base member 12 frictionally engage a floor, or alternate substantially planar horizontally disposed surface upon which human subject 20 lies, and furthermore said human subject 20 lies prone and face up positioning the atlantooccipital joint region of the cervical spine 22 substantially upon cervical support member 14.

Figure 3:
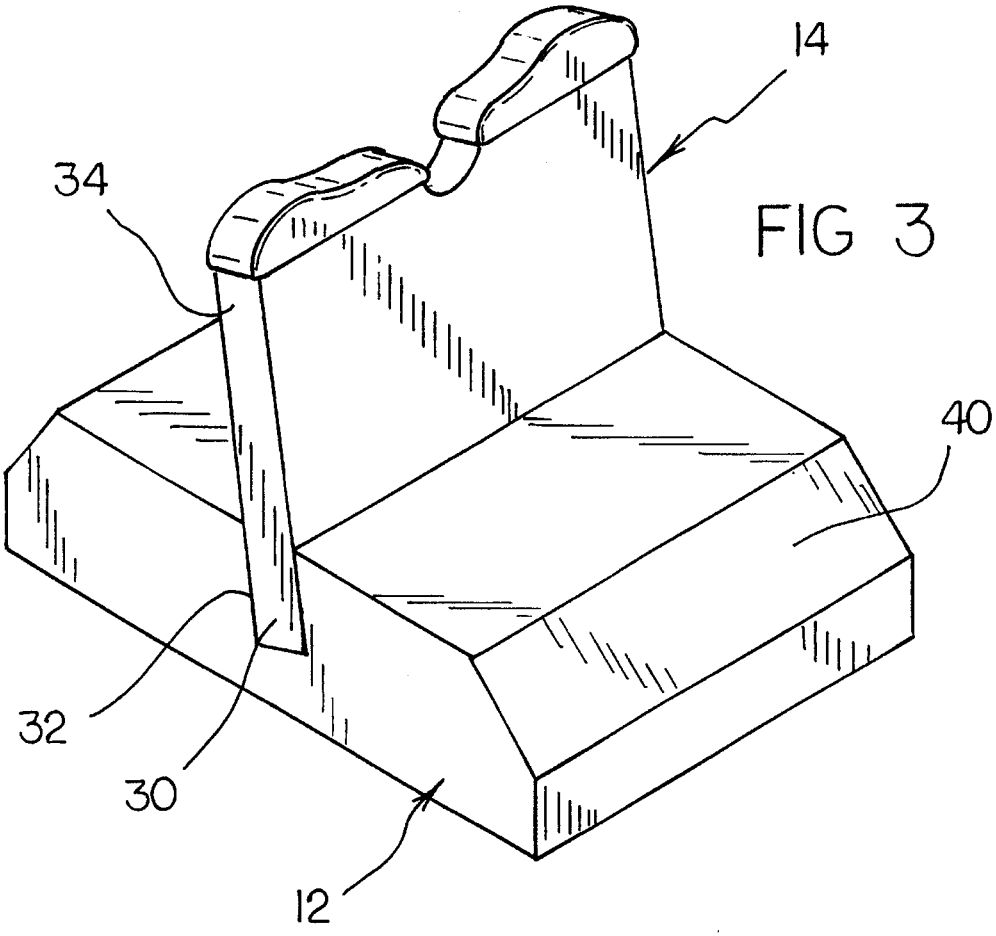
FIG. 3 is perspective view of the cervical tee appliance.
Figure 4:
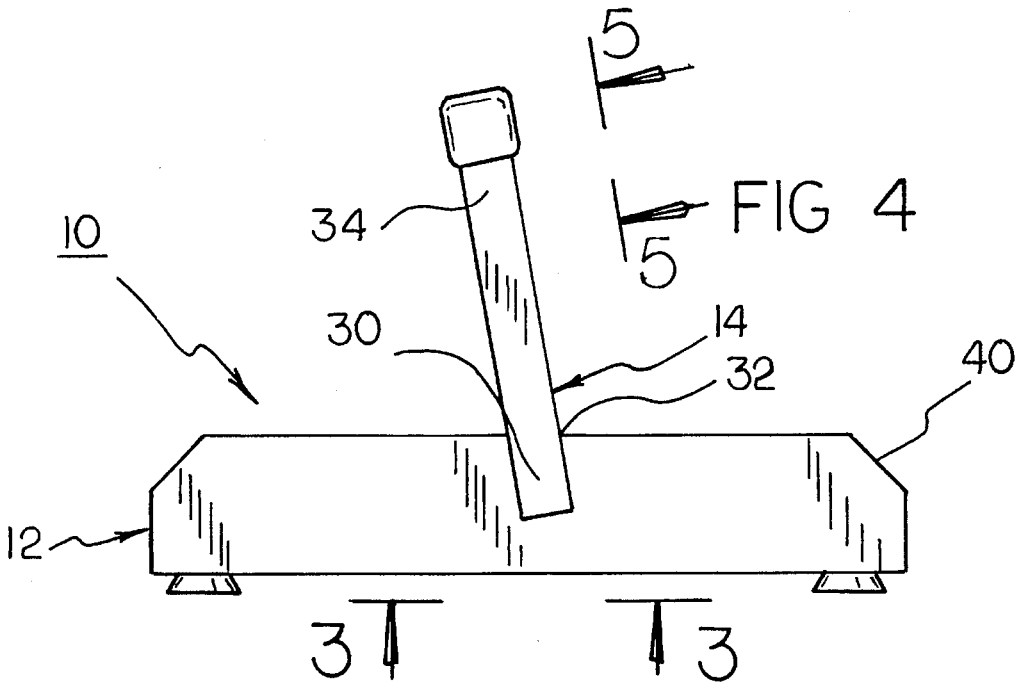
FIG. 4 is a side elevational view of the cervical tee appliance showing an angular engagement of a cervical support member.

Cervical support member 14 comprises a plate nominally 9.5 mm (0.375 inch) thick having a first portion 30 engaging slot 32 of base member 12 and a second portion 34 engaging the atlantooccipital joint of human subject 20. Cervical support member 14 may be of wood, plastic, composite, or any other construction providing adequate strength and durability to support the human cervical region, head, and a portion of the human shoulder region. See FIGS. 3 and 4. First portion 30 is finished in a generally straight end cut wherein the cut is substantially orthogonal to adjoining sides of base member 12.

Second portion 34 has a contoured end finish specifically designed to engage and support the atlantooccipital joint and surrounding cervical and occipital regions of the human form. Base member 12 comprises a thick singly slotted plate and may have chamfers 40 or other features to smooth sharp edges, eliminate possible interference with the human subject, and further improve appearance. Slot 32 is of sufficient depth to provide stability to cervical support member 14 being disposed therein, and furthermore slot 32 is angularly disposed with respect to a normal to a major surface of the base member 12 wherein the angle formed is nominally ten degrees.

Smaller and larger angles may be used to control the component of force applied along the axis of the cervical spine. All forces experienced in use of the cervical tee appliance are gravitationally induced and arise from the weight of the head, neck, a portion of the shoulders, and the human body. The angular disposition of the cervical support member insures that the primary cervical force applied has components both along the axis of the cervical vertebrae and in a direction substantially orthogonal to the axis of the atlantooccipital joint, and furthermore that the axial forces applied produce tensile responses in several muscles, ligaments, and tendons joining various portions of the occipital bone and the cervical vertebrae.

Figure 5:
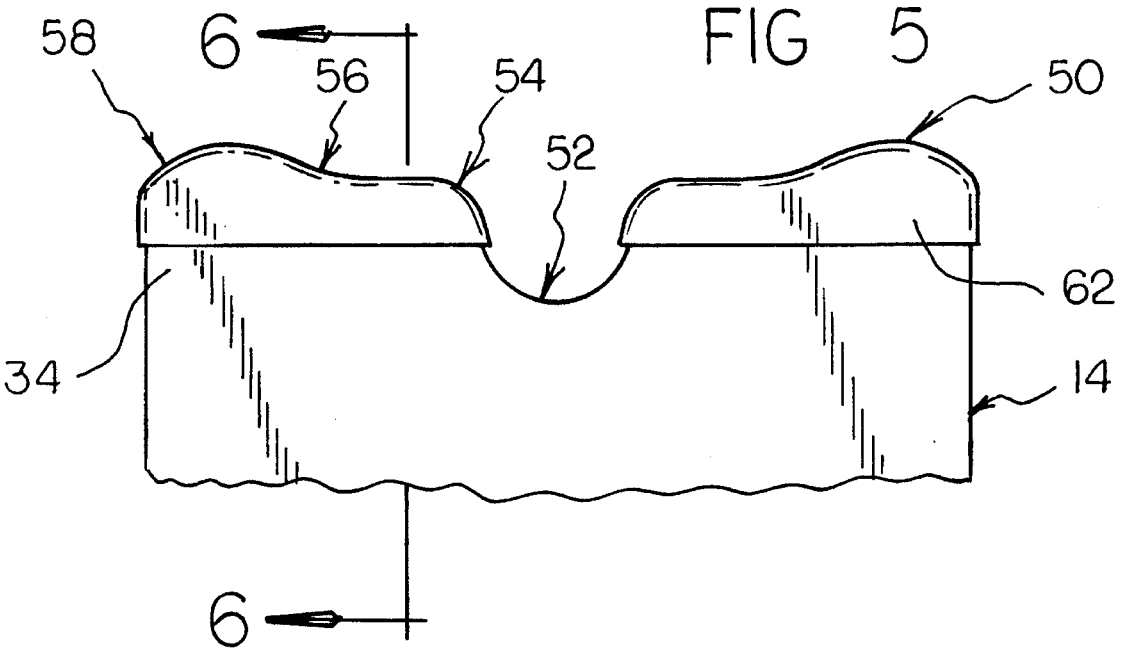
FIG. 5 is a fragmentary side elevational view of a cervical tee appliance showing a cervical engagement portion.
Figure 6:
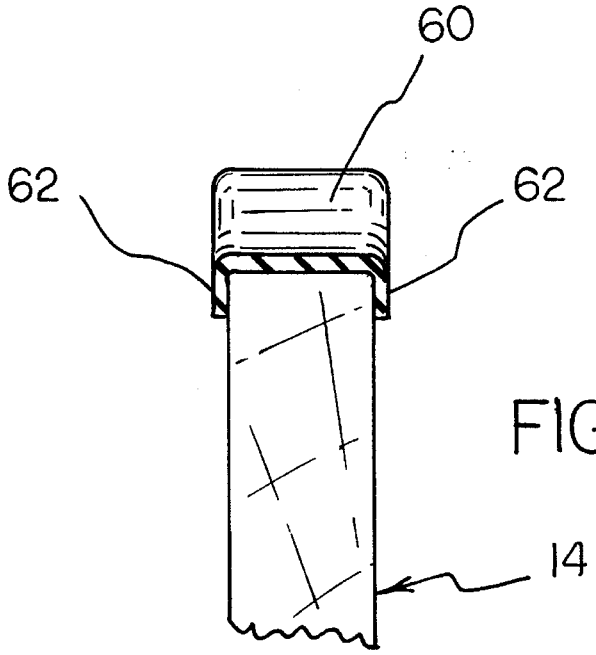
FIG. 6 is a side sectional view of the cervical tee appliance taken substantially upon the plane indicated by the section lines 6—6 of FIG. 5.

Although ten degrees is an angle preferred for the general modality angles greater than ten degrees may be employed to generate greater cervical axis force components and angles less than ten degrees to generate reduced cervical axis force components. See FIGS. 5 and 6.

The supporting contour 50 of cervical support member 14 second portion 34 is symmetrically disposed about a centerline passing through the cervical spine 22 of the human subject 20 and a central plane passing through base member 12. Contour 50 comprises a central concave portion 52 having substantially semicircular curvature and of sufficient depth to provide clearance for the cervical spine wherein a sufficient depth is nominally 16 mm (0.625 inch). Approximately 12.7 mm (0.5 inch) from said centerline and on either side of said centerline a convex curvature 54 of contour 50 begins and smoothly adjoins a substantially flattened portion 56 wherein substantially flattened portion 56 is cut to a depth of 3 mm (0.125 inch).

Substantially flattened portion 56 adjoins a convex portion 58 which extends to the outer limits of cervical support member 14. The purpose of contour 50 is to simulate the curvature of the hands of a therapist in performing supportive massage of the atlantooccipital joint region and therefore the curvature may deviate somewhat from that aforedescribed in order to more closely match the character of practical therapeutic manipulation.

The overall width of cervical support member 14 is 89 mm (3.5 inch) and the position of the topmost portion of the cervical support member is 108 mm (4.25 inches) above the floor when the cervical tee appliance 10 is operationally disposed. The second portion 34 of the cervical support member 14 is covered by padding member 60. Padding member 60 comprises a soft conformably fitting material such as felt or rubber which may be adhesively attached or be stretch fitted to the cervical support member 14 in a manner whereby a portion 62 of the padding member 60 extends over the sides of the cervical support member 14.

The thickness of said padding member 60 results in a substantial increase in overall thickness of the second portion 34 of the cervical support member 14 rendering a resultant thickness at the covered portion of second portion 34 a nominal 16 mm (0.625 inch). See FIGS. 7 and 8. Base member 12 comprises an underside portion 70 having a non-skid device attached thereon. The non-skid device may comprise a coating or an adhesively affixed film which increases the frictional engagement of the cervical tee appliance with the floor.

Or, a plurality of foot members 72 may be attached to base member 12 which, in one application, are individually composed of a rubbery substance pressed into an engaging cavity 74. Overall height of the cervical tee appliance is critical in therapeutic disposition, therefore any height change incurred by introduction of foot members 72 is compensated to preserve the overall height relationship.

In an alternate embodiment, a cervical tee appliance having an adjustable angular disposition of cervical support member 14 may be employed to provide enhanced potential in therapeutic applications.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

What is claimed as being new and desired to be protected by Letters Patent of the United States is as follows:

1. A cervical tee appliance for providing directed support for the atlantooccipital joint comprising:

a cervical support means angularly disposed to the vertical when operationally disposed, the cervical support means comprises a plate having a first portion and a second portion, the second portion engaging the cervical spine and overlying areas of a human subject wherein said cervical spine engagement is substantially upon the alantooccipital joint, and furthermore said second portion is contoured at the areas of engagement with the human subject, the second portion contour has a centrally located substantially semicircular cutout of adequate depth to preclude engagement of the central portion of the posterior cervical spine in the region of the atlantooccipital joint, the second portion has a substantially convex curvature region adjoining a substantially planar region, and terminating in substantially convex region, wherein each region is disposed sequentially in proceeding from the central semicircular cutout toward the edges of said cervical support means, and furthermore said substantially planar region, and terminating in a substantially convex region, wherein each region is disposed sequentially in proceeding from the central semicircular cutout toward the edges of said cervical support means; and a base member engaging said first portion of said support member and maintaining the adjusted angular disposition of the cervical support means and furthermore said base member frictionally engages a floor or other planar surface.

* * * * *